US005910711A

United States Patent [19]

Porath et al.

[11] Patent Number: 5,910,711

[45] Date of Patent: Jun. 8, 1999

[54] DISCHARGE LAMP DIMMER CIRCUIT WITH PIEZO-ELECTRIC TRANSFORMER AND ADJUSTABLE CAPACITOR

[75] Inventors: Rebekka Porath; Achim Hilgers, both of Aachen, Germany

[73] Assignee: U.S. Philips Corporation, New York, N.Y.

[21] Appl. No.: 08/976,646

[22] Filed: Nov. 24, 1997

[30] Foreign Application Priority Data

Dec. 2, 1996 [EP] European Pat. Off. ..... 96203406

[51] Int. Cl.[6] ..... G05F 1/00

[52] U.S. Cl. ..... 315/291; 315/209 PZ; 315/DIG. 2; 315/DIG. 5; 310/311

[58] Field of Search ..... 315/209 PZ, 224, 315/227 R, 241 R, 291, DIG. 2, DIG. 5; 310/311, 314, 316, 318, 319

[56] References Cited

U.S. PATENT DOCUMENTS

| | | | |
|---|---|---|---|
| 3,691,410 | 9/1972 | Kawada | 310/8.1 |
| 3,700,936 | 10/1972 | Shimizu | 310/8.1 |
| 5,084,801 | 1/1992 | El-Hamamsy et al. | 361/277 |
| 5,701,049 | 12/1997 | Kanayama et al. | 310/359 |
| 5,705,877 | 1/1998 | Shimada | 310/318 |

FOREIGN PATENT DOCUMENTS

| | | |
|---|---|---|
| 0706306A2 | 10/1995 | European Pat. Off. . |
| 8222391 | 8/1996 | Japan . |

*Primary Examiner*—Don Wong
*Assistant Examiner*—Haissa Philogene
*Attorney, Agent, or Firm*—Bernard Franzblau

[57] ABSTRACT

A circuit arrangement for operating a discharge lamp comprising an oscillator for generating a high frequency input voltage and a piezo-electric transformer with input terminals coupled to the oscillator and output terminals. A load circuit is coupled to the output terminals of the piezo-electric transformer and includes terminals for lamp connection. The load circuit comprises an adjustable capacitor which forms a very simple device for controlling the light output of the discharge lamp over a wide range.

10 Claims, 1 Drawing Sheet

DISCHARGE LAMP DIMMER CIRCUIT WITH PIEZO-ELECTRIC TRANSFORMER AND ADJUSTABLE CAPACITOR

BACKGROUND OF THE INVENTION

This invention relates to a circuit arrangement for operating a discharge lamp comprising

- an oscillator for generating a high frequency input voltage,
- a piezo-electric transformer equipped with input terminals coupled to the oscillator and output terminals,
- a load circuit coupled to the output terminals of the piezo-electric transformer and comprising terminals for lamp connection.

The invention also relates to a liquid crystal display comprising such a circuit arrangement.

Such a circuit arrangement is known from EP 0706306 A2. The known circuit arrangement is very suitable to be used for operating the type of low pressure mercury discharge lamp that is used as back light in a liquid crystal display. These low pressure mercury discharge lamps have a relatively high ignition voltage and also a relatively high operating voltage. An important advantage of circuit arrangements incorporating a piezo-electric transformer is that the frequency of the high frequency input voltage can be maintained at the same value during both ignition and stationary operation. This has the advantage that the configuration of the circuit arrangement can be relatively simple. Another important advantage is that since a piezo-electric transformer is generally very small, the circuit arrangement in turn can also be very small. A disadvantage of the known circuit arrangements is that for them to be able to dim the lamp, they need to comprise relatively complicated dimming circuitry. This relatively complicated dimming circuitry renders the circuit arrangement expensive and bulky.

SUMMARY OF THE INVENTION

The invention aims to provide a circuit arrangement with which the lamp can be dimmed over a relatively wide range while the dimming circuitry comprised in the circuit arrangement is very simple so that the circuit arrangement is relatively cheap and can be relatively small.

A circuit arrangement as mentioned in the opening paragraph is therefore in accordance with the invention characterized in that the load circuit comprises an adjustable capacitor.

It appeared possible to strongly effect the amount of power supplied by the circuit arrangement to the discharge lamp by adjusting the capacitance of the adjustable capacitor over a relatively small range. In this way the discharge lamp could be effectively dimmed over a wide range making use of very simple means. An additional advantage of the circuit arrangement according to the invention is that the adjustable capacitor makes it possible to compensate for the effects introduced by parasitic capacities comprised in the lamp and/or in the wiring and the terminals for lamp connection. It has been found that slight differences in these parasitic capacitances that exist between embodiments of the same type of circuit arrangement result in relatively large differences in light output of similar lamps under similar operating conditions. By adjusting the capacity of the adjustable capacitor these effects can be compensated. As a further advantage it can be mentioned that it has been found that also the efficacy of the circuit arrangement can effectively be controlled by adjusting the capacity of the adjustable capacitor.

Preferably the adjustable capacitor connects the output terminals of the piezo-electric transformer. It has been found that when it was configured this way, the adjustable capacitor could be used to dim the lamp over a relatively large range.

Good results have been obtained for circuit arrangements wherein the piezo-electric transformer is of the Rosen type.

The dimming facility of the circuit arrangement according to the invention has been found to function very satifactorily in the case where the discharge lamp is a low pressure mercury discharge lamp. More in particular this is true for the type of low pressure mercury discharge lamp that is used as back light in a liquid crystal display. A circuit arrangement according to the invention is small, relatively cheap and includes the facility of adjusting the light output of such a lamp and is therefore very suitable for use in a liquid crystal display.

BRIEF DESCRIPTION OF THE DRAWING

An embodiment of the present invention will be illustrated with reference to the accompanying drawing.

In the drawing

DESCRIPTION OF THE PREFERRED EMBODIMENTS

Figure 1:
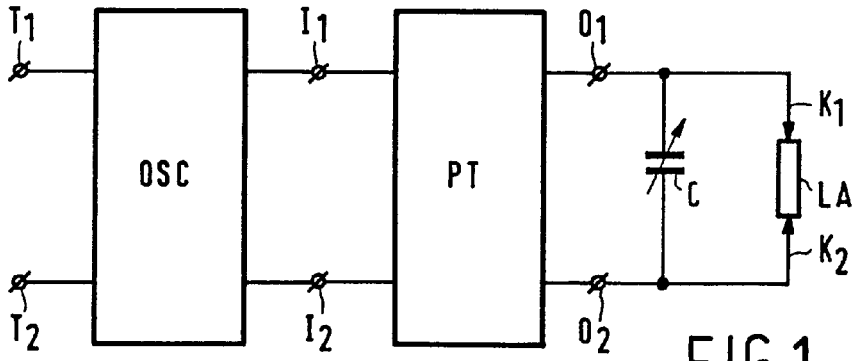
FIG. 1 is a schematic representation of an embodiment of a circuit arrangement according to the invention together with a connected discharge lamp.

In FIG. 1, T1 and T2 are terminals for connection to a supply voltage source. T1 and T2 are connected to respective input terminals of oscillator OSC for generating a high frequency input voltage. Input terminals I1 and I2 of a piezo-electric transformer are coupled to respective output terminals of oscillator OSC. Output terminals O1 and O2 are connected by means of adjustable capacitor C and by means of the discharge lamp La. K1 and K2 are terminals for lamp connection. The adjustable capacitor C and the terminals K1 and K2 together form a load circuit.

The operation of the embodiment shown in FIG. 1 is as follows.

In case terminals T1 and T2 are connected to the poles of a supply voltage source the oscillator OSC generates a high frequency input voltage having a substantially constant frequency which is chosen in the vicinity of the first resonance frequency of the piezo-electric transformer PT. The high frequency input voltage is present between the input terminals I1 and I2 of the piezo-electric transformer and is transformed by the piezo-electric transformer to a high frequency output voltage of the same frequency that is present between output terminals O1 and O2 and therefore over the discharge lamp La and the adjustable capacitor C. By adjusting the capacity of the adjustable capacitor the amount of power supplied to the lamp and thereby the light output of the lamp can be controlled.

Figure 2:
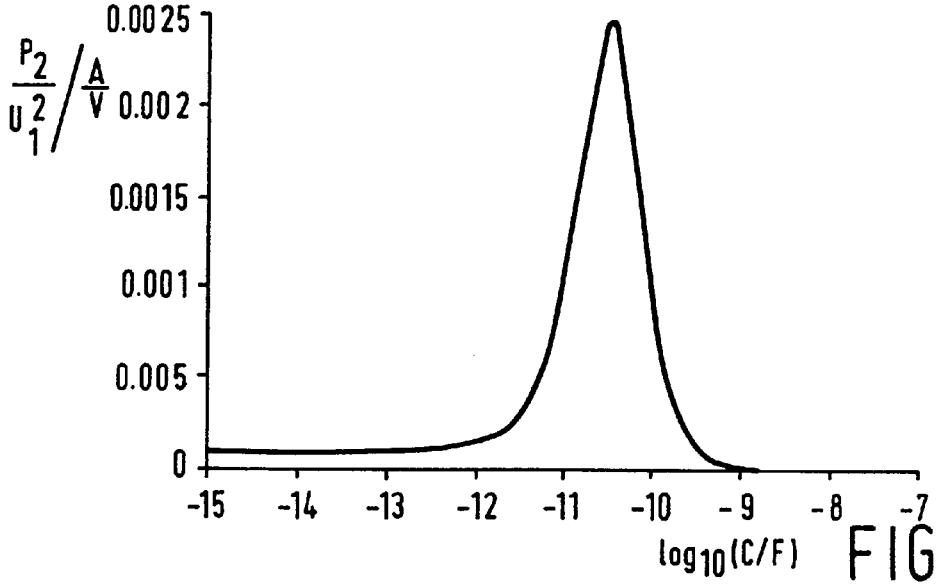
FIG. 2 shows the amount of power that is delivered by the circuit arrangement shown in FIG. 1 to the discharge lamp as a function of the capacity in parallel with the discharge lamp.
Figure 3:
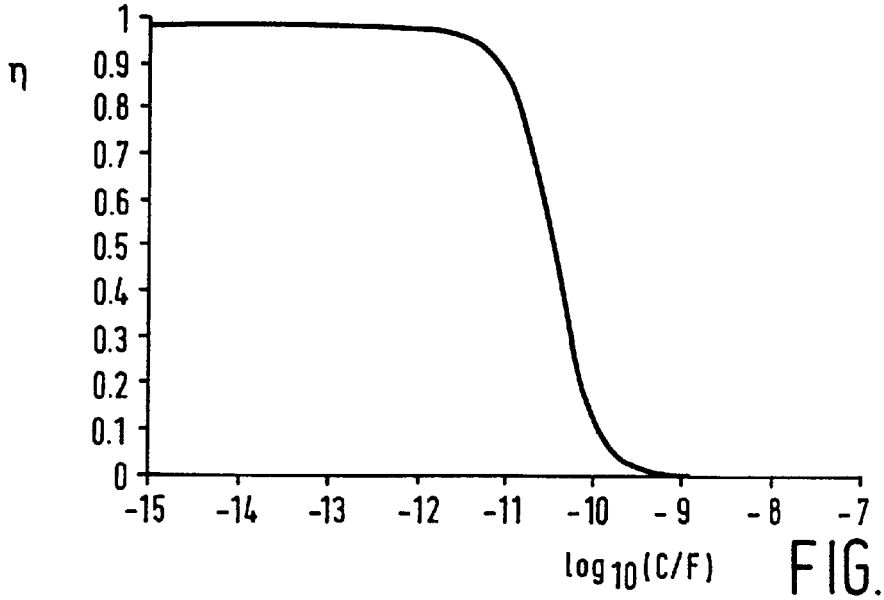
FIG. 3 shows the efficacy of the circuit arrangement shown in FIG. 1 as a function of the capacity in parallel with the discharge lamp.

The quantitative data shown in FIG. 2 and FIG. 3 were obtained for a circuit arrangement comprising a piezo-electric transformer of the Rosen type supplied by Philips Electronics and shaped as a rectangular parallelopiped. The dimensions of the piezo-electric transformer were 38 mm *

5 mm * 2 mm and it was constructed out of the material PXE43. The high frequency signal generated by the oscillator OSC was sinusoidal and had a frequency of 35 kHz. The lamp operated by means of the circuit arrangement was a low pressure mercury discharge lamp of the type NDF-M6 supplied by Philips Electronics.

FIG. 2 shows the relative power supplied to the lamp as a function of the capacity in parallel with the discharge lamp. The relative power here means the power (P2) divided by the square of the amplitude of the high frequency input voltage generated by oscillator OSC. This relative power is plotted along the vertical axis in units of A(mpere)/V(olt). The logarithm of the capacity in parallel with the lamp in Farad is plotted along the horizontal axis. It can be seen that the power supplied to the lamp is a very strong function of the capacity in parallel with the lamp and shows a sharp peak in the vicinity of a value of approximately 45 pF.

FIG. 3 shows the efficacy $\eta$ of the circuit arrangement as a function of the capacity that is in parallel with the lamp. The efficacy is plotted along the vertical axis and the logarithm of the capacity (in Farad) in parallel with the lamp is plotted along the horizontal axis. It can be seen that the efficacy drops off very steeply for values of the capacity in parallel with the lamp that correspond to a high relative power supplied to the lamp. FIG. 2 and FIG. 3 illustrate that if both the requirement of a relatively high relative power supplied to the lamp and the requirement of a reasonable efficacy of the circuit arrangement are to be met at the same time the choice of the capacity in parallel with the lamp is very limited. Since in practice the value of the capacity in parallel with the lamp results from parasitic capacities as well as from the adjustable capacitor, it is very advantageous to be able to compensate for the effects of the parasitic capacities by adjusting the capacity of the adjustable capacitor.

We claim:

1. A dimmer circuit for operating a discharge lamp comprising:

an oscillator for generating a high frequency input voltage whose frequency is substantially constant, a piezo-electric transformer having input terminals coupled to the oscillator and output terminals, a load circuit coupled to the output terminals of the piezo-electric transformer and comprising terminals for lamp connection, and wherein the load circuit comprises an adjustable capacitor.

2. The dimmer circuit as claimed in claim 1, wherein the adjustable capacitor is connected to the output terminals of the piezo-electric transformer.

3. The dimmer circuit as claimed in claim 1, wherein the piezoelectric transformer is of the Rosen type.

4. The dimmer circuit as claimed in claim 1 wherein the discharge lamp is a low pressure mercury discharge lamp.

5. A liquid crystal display equipped comprising a dimmer circuit claim 1.

6. The dimmer circuit as claimed in claim 1 wherein the combination of the oscillator and the piezo-electric transformer maintain a substantially constant frequency of said high frequency input voltage without reference to current flow in the discharge lamp.

7. The dimmer circuit as claimed in claim 1 wherein the adjustable capacitor is accessible to a user of the dimmer circuit whereby the user can adjust the capacitance of the adjustable capacitor so as to adjust the light level produced by the discharge lamp.

8. The dimmer circuit as claimed in claim 1 wherein the frequency of the oscillator high frequency input voltage is in the vicinity of a first resonance frequency of the piezo-electric transformer.

9. A method of dimming the light output of a discharge lamp, comprising the steps of:

generating a high frequency voltage and applying said high frequency voltage to input terminals of a piezo-electric transformer, coupling a load circuit to output terminals of the piezo-electric transformer, wherein the load circuit includes terminals for connection of the discharge lamp, and dimming the light output of the discharge lamp by adjusting the capacitance of an adjustable capacitor connected in said load circuit.

10. The light dimming method of claim 9 wherein the frequency of the high frequency voltage is kept constant independently of current flow in the discharge lamp.

* * * * *